United States Patent [19]

Maietta

[11] Patent Number: 5,035,015

[45] Date of Patent: Jul. 30, 1991

[54] INFANT FURNITURE

[76] Inventor: Linda S. Maietta, Rte. 9, Box 86 H.M., Santa Fe, N. Mex. 87505

[21] Appl. No.: 486,317

[22] Filed: Feb. 28, 1990

Related U.S. Application Data

[63] Continuation of Ser. No. 174,378, Mar. 28, 1988, abandoned.

[51] Int. Cl.[5] ..... A47C 20/00

[52] U.S. Cl. ..... 5/431; 5/446

[58] Field of Search ..... 5/431, 434, 436, 437, 5/465, 446; 297/458, 459, 118, DIG. 1

[56] References Cited

U.S. PATENT DOCUMENTS

| | | | |
|---|---|---|---|
| 3,378,862 | 4/1968 | Skinner | 5/462 |
| 3,742,528 | 7/1973 | Münch | 5/462 |
| 3,987,507 | 10/1976 | Hall | 5/436 X |
| 4,288,879 | 9/1981 | Pate | 5/462 X |
| 4,566,449 | 1/1986 | Smith | 5/431 X |
| 4,777,678 | 10/1988 | Moore | 5/446 X |

*Primary Examiner*—Gary L. Smith
*Assistant Examiner*—Michael J. Milano
*Attorney, Agent, or Firm*—McCubbrey, Bartles, Meyer & Ward

[57] ABSTRACT

An apparatus is described which optimizes the neurological development in an infant placed therein and which enables the positioning of the infant in relation to a care giver to enhance mutual interaction skills. A plurality of pillows are provided shaped in geometrical configurations. The pillows include two large wedge shaped foundation pillows which mate together and which can be attached to form a substantially rectangular solid. One of the foundation pillows has a hemispherical recess in the inclined surface thereof in which a removable hemispherical detail pillow may be placed. Other smaller detail pillows provide for unidirectional and compound motion in connection with infant activities. The foundation pillow which does not contain the substantially hemispherical recess is provided with a recess to accommodate at least some of the detail pillows for storage.

6 Claims, 3 Drawing Sheets

INFANT FURNITURE

This is a continuation of application Ser. No. 174,378 filed Mar. 28, 1988 and now abandoned.

FIELD OF THE INVENTION

The present invention has to do with a novel type of furniture which permits newborn infants to activley participate in exchanges with adults and to be handled more comfortably and more conveniently by adults.

BACKGROUND OF THE INVENTION

The field of behavioral cybernetics has convincingly demonstrated that mutual exchanges between parents and infants during caretaking, play, and transporting activities is critical for both infant development and the development of positive family relationships. While there are an abundance of devices to restrain and secure infants during rest, play and caretaking activities, as far as we can determine, no devices have been invented to facilitate, enhance, and differentiate the efforts of newborns and thereby facilitate mutuality between infants and parents. Nor are there devices explicitly created to maximize mutual exchanges between parents and infants to enhance mutual learning between them.

In utero, babies live in a coherent, self generated world that fits their bodies and facilitates their ability to function. They are able to sit, stand, kneel and lie down. By moving their body parts and pushing against the walls of their environment they can make the motions of walking, crawling and even somersaulting. At birth they leave that world. They enter a world created by, and primarily for, grown-ups. This new world is often not designed to facilitate their growth and development. Neither is this world designed to facilitate the development of positive habits of relating between the newborn and other family members.

The principle object of the present invention is a set of pillows which were invented to remedy the foregoing condition, and which are characterized by multiple functions.

A further object is to bridge the gap between the physical conditions of interuterine life which fits the form and function of the developing fetus. To that of neonatal life in a world created by big people, for big people with little attention to the spatial, temporal or dynamic requirements of infants. The shapes and sizes of the pillows are intended to enable the baby to continue to do what was possible before birth with the help of participating parents.

An additional object is to assist newborn/infants to differentiate their body parts thereby enhancing their developmental base in the first few months of life. The carefully chosen forms of pillows for this purpose give systematic experience in every possible joint function for both the parent and infant even without the parent having specific knowledge of these functions.

Another object is to factor the physical space between parents and infants so that they both have optimized ranges of motion relative to each other during caretaking, play, and transporting interactions. The pillow set of this invention provides the spatial conditions between the small bodies of the infants and the huge (by comparison) bodies of adults that make it possible for baby and adult to meet on equal ground where exchanges can be mutual in nature right from the first moments of the infants' life.

Another object is to have the pillows serve as a medium to encourage mutual exchanges between infants and parents even without the parents having an intellectual or conceptual understanding of how to go about it. The parents can use the pillows in diverse ways to position themselves so that their efforts can match those of their infant in force, timing and use of space. In this way the pillow set serves to encourage and aid parents and infants in establishing effective patterns of relating without doctrinaire and theoretical instructions of how parents should relate to babies.

A further object is to use the pillows for factoring the environment for adults for their own comfort and improved function.

SUMMARY OF THE INVENTION

The pillow props of the present invention comprise a series of interacting geometric fabric-covered foam forms. The pillows are comprised of wedge shapes and other smaller pieces formed from medium-dense, flexible foam with a water impermeable surface. They may be covered with fabric which can be removed for cleaning. One wedge has a scoop cut out of the center in the form of a part of a hemisphere. It also has an extension on its' heighth edge which makes it more difficult to tip over when it is sitting on its' base edge, with the baby in its' scoop. The smaller detail pillows consist of the dome shaped part of the hemisphere cut out of the scoop, a column, an oblong square, an oblong rectangle, and two oblong wedges. Except for the dome shaped pillow which fits into the scoop, the rest of the detail pillows fit into a rectangular cut in the second wedge. An alternate embodiment would be to store the other detail pillows in a net retainer attached to the heighth edge of the simple wedge. The pieces all fit together to form a single rectangular solid which is held together with fabric straps and snaps where the pillows meet when stacked with their bases facing. A carrying handle is attached to the straps on one side. In this way the pillow prop set can easily be carried about or stored when not in use.

DESCRIPTION OF THE DRAWINGS

The invention may be more readily understood by referring to the various figures and numbered parts of the drawings.

FIG. 13 also demonstrates how the foundation pillows fit together.

DETAILED DESCRIPTION OF THE INVENTION

Referring to the parts of the drawings by number, they are as follows:

The system includes two foundation pillows, namely, a scoop wedge (8) and simple wedge (4).

Figure 12:
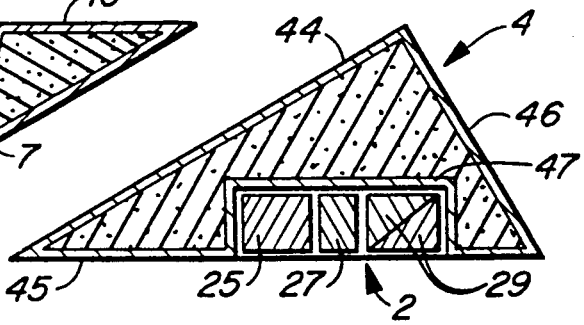
FIG. 12 is a sectional view of the scoop wedge along the line 12—12.

The scoop wedge (8) is provided with a hollow (1) in its sloping surface (16). The simple wedge (4) is provided with a rectangular hollow (2). The scoop wedge (3) has an extension (3) of rectangular cross-section, providing a short rectangular undersurface (6) extending from a sloping undersurface (7), FIG. 3. The remaining elements are the shaped partial hemisphere (21) FIG. 16, the column (23) FIG. 19, the oblong square cross-section detail pillow (25) FIG. 22 the oblong rectangular cross-section detail pillow (27) FIG. 25, and the two oblong wedge detail pillows (29) FIG. 28. The rectangular hollow (2), is cut out of the sloping surface (9) of the simple wedge, FIG. 6 and FIG. 12, so that the rectangular square cross-section and wedge detail pillows FIG. 22, FIG. 25 and FIG. 28, can fit into the same to make the surface (9) continuous. Both foundation pillows of the present invention are held together with two simple snaps (10), attached with webbing (11), to each side, midway, along the base edge of each pillow. A webbing handle (12), is attached to the straps on one side to carry the whole package when it is so combined.

The two foundation pillows can be configured to form almost endless irregular solid forms with surfaces to support the infant in appropriate positions relative to the parents as well as relative to the baby's own body parts. The foundation pillows have cut out solids that, when removed, provide differentiated spaces for the infant and the parents to recline, sit or stand in. The cut outs provide additional differentiated support. We assume that the scoop and the support of the detail pillows constitutes a modified substitute for the interuterine environment and thereby makes it possible for infants, with the aid of their caretakers to avoid the shock and setback that is normally experienced by newborns when they are placed in a flat undifferentiated environment designed by adults for adults.

The foundation pillows and the cut out detail pillows (21, 23, 25, 27 and 29) provide two basic kinds of forms whose surfaces relate to two basic kinds of human joint action. These actions are motions that are unidirectional such as at the occiput/axis, manubrium/sternum, elbow, knee, wrist and ankle, and the motions that are compound-directional as in the cervical spine, shoulder girdle, lumbar spine, hip, lower arm and lower leg. The surfaces of the forms are either linear or curvo-liner. When infants are supported by these forms, one or another of the functions made possible by unidirectional or compound-directional motion in their bodies is facilitated. The elongated forms allow for movement at right angles to their long axis. This engages postural movement (unidirectional) functions. Progressing from the oblong round detail pillow through the oblong square and rectangular pillows to the oblong wedges, these forms offer the least to the most resistance to unidirectional movement.

The partial half-dome form (21) as well as the space (1) from which it is cut, has it's greatest influence on the compound-directional movements of transport. When on the convex surface with the flat surface against the ground, the infant is encouraged to make transport movements. When placed on the flat surface with the convex surface against the ground, the infant must hold the compound-directional motion functions quiet in order not to fall off. Unidirectional postural movement is activated in this condition. In this way, postural functions are differentiated and learned in relationship to transport functions. It is believed that this systematic and pervasive experience of the many possible human motions is desirable for enhanced infant development.

When the baby is in the scoop (1) with various support from the detail pillows (23, 25, 27 and 29), both transport and postural functions are differentiated and integrated. This contributes to the infant's development of the ability to perform complex behaviors such as turning over, coming to sitting, and even standing aided by the supportive environment that is continuously factored by the parent.

In order to be effective in the use of the pillows (21, 23, 25, 27 and 29), the parents need not understand the complex concepts of human factoring in learning. They need only use the pillow props as part of the environment in which they engage in interacting with their infant. The physical and physiological relationships that pertain to the infant and the pillows results in optimizing the development of broad and complete motor-sensory foundations of posture and transport in the baby. Additionally, the pillow prop encourages qualities and attitudes of mutual relationship between the infant and parents. These attitudes and skills have been shown to be crucial to positive traits of learning, social, creative, productive and civic behavior in all human beings. We conceive of the pillow props as a tool for positive health development where basic democratic principles of mutual interaction between infants and adult parents are worked out and laid down as the foundation of like long interpersonal relation skills.

Figure 1:
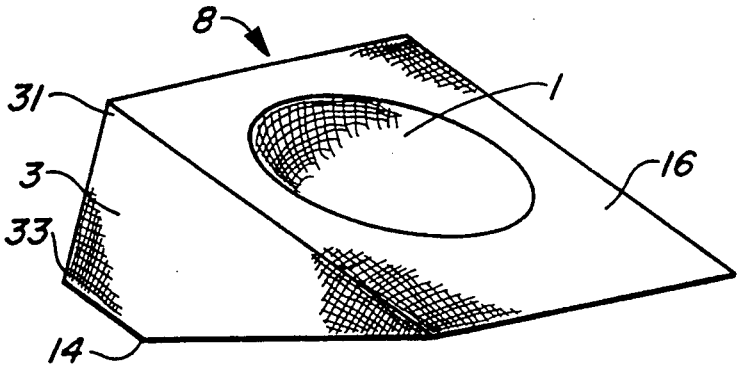
FIG. 1 is a perspective view of the scoop wedge.
Figure 6:
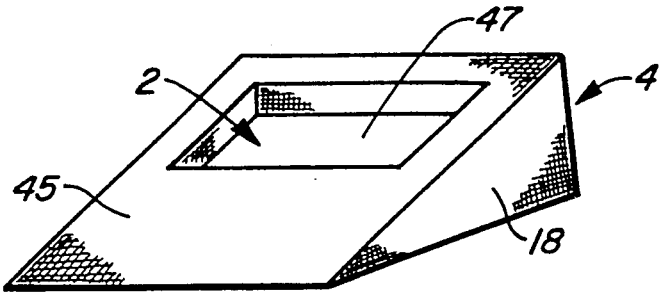
FIG. 6 is a perspective view of the simple wedge.
Figure 11:
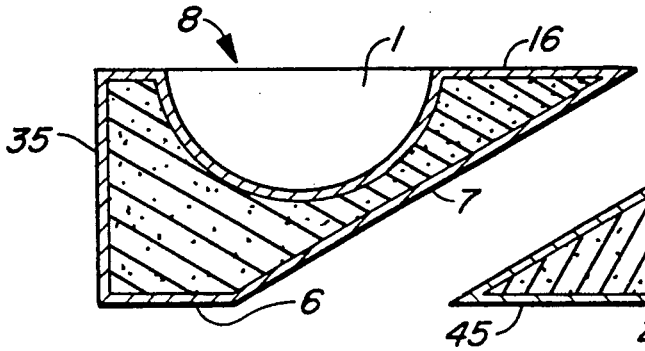
FIG. 11 is a sectional view of the scoop wedge along the line 11—11.

Referring now to the scoop wedge (8) FIG. 1 which is a regular right angle solid triangle with an extension, 3, along its height edge that prevents it from easily tipping when it is placed against, the ramp surface (9), of the simple wedge (4) FIG. 6, with the scoop, (1), exposed and the undersurface of the extension, (3), is downward. In contrast, when the undersurface (7) of the extension (3) is not positioned against the simple wedge (4), FIG. 6, the parent can sit in the scoop and use the extension (3) as the fulcrum, (14), for rocking the seat. The extension (3) is of such a size as to form right angles 31 and 33 with the top surface (16) of the wedge (8) as well as the under surface (6).

Figure 2:
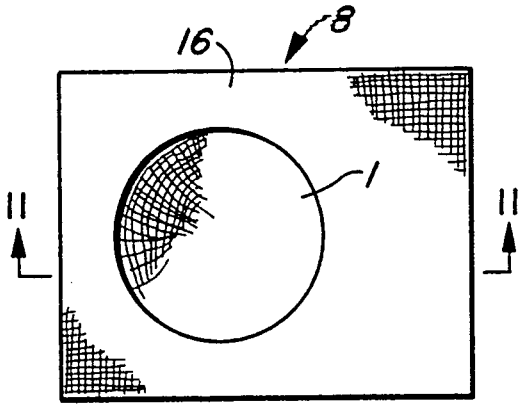
FIG. 2 is a top view of the scoop wedge.
Figure 7:
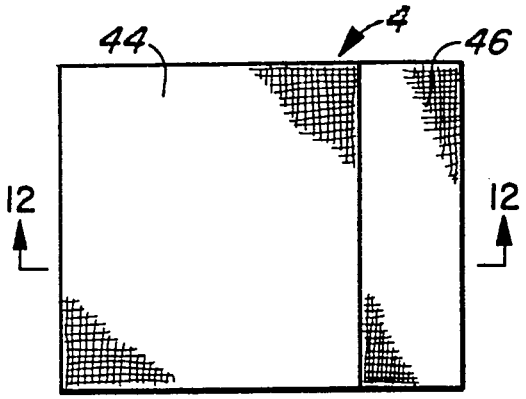
FIG. 7 is a top view of the simple wedge.
Figure 3:
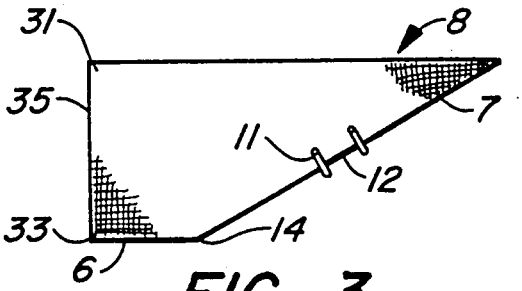
FIG. 3 is a side view of the scoop wedge with attached carrying handle.
Figure 8:
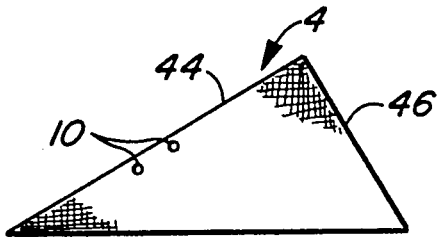
FIG. 8 is a side view of the simple wedge with snaps attached.
Figure 4:
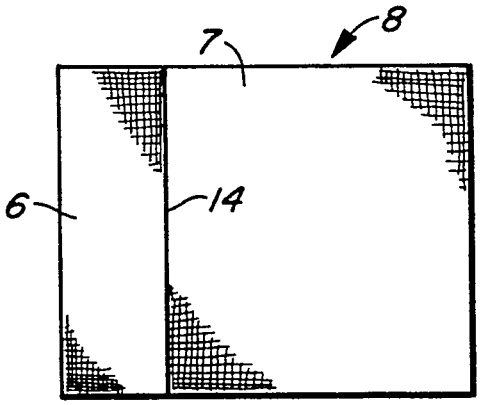
FIG. 4 is a bottom view of the scoop wedge.
Figure 5:
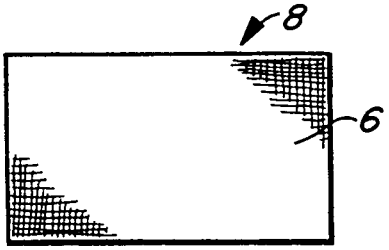
FIG. 5 is an end view of the scoop wedge.

The wedge pillow (8) of FIG. 1 is generally wedge-shaped and has an upper surface (16), FIG. 2, a slanting undersurface 7, a rear surface (35) FIG. 5, with an extension undersurface (7) and two opposite mirror-image side surfaces (37), FIG. 3. The plane of the hypotenuse side or slanting surface (16) of the scoop wedge (8), is broken by a partial hemisphere cavity, (1), placed so as to leave a thickness of at least two inches of foam where the scoop approximates the sides of the wedge. The great circle of the partial hemisphere that forms the scoop lies in the surface (16). Ideally, the scoop (1), forms a regular curvo-linear three dimensional cavity that simulates the spatial relationships pertinent to intra-uterine conditions of pre-natal life. The form also fits the seat of post-delivery mothers in such a way as to relieve pressure on their perineum when seated in it. When the mother sits in this cavity she is relieved of the discomfort to that area following the trauma to that part of the body as a result of giving birth.

Furthermore, when seated in the scoop cavity (1) with the foundation pillows wedged against each other or with the scoop wedge sitting on a couch or other suitable furniture surface, the mother is in an ideal position to nurse here baby since the pillow arrangement places all of her body parts in neutral positions relative to the infant so that she can respond in all directions to the movement of the baby on here lap or in her arms.

Figure 16:
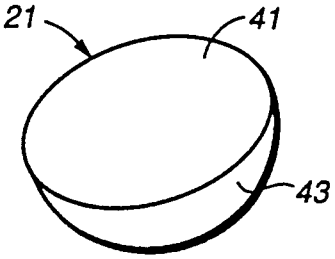
FIG. 16 is a perspective top and side view of the partial half-dome pillow.
Figure 17:
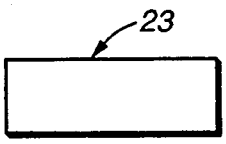
FIG. 17 is a side view of the oblong round detail pillow.
Figure 18:
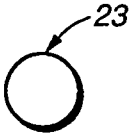
FIG. 18 is a end view of the oblong round detail pillow.

The dome form detail pillow (21) of FIG. 16 fits into the cavity (1) where it completes the plane (16), to form a flat working surface for diaper changing and other parent-infant activities. The height of the combined pillow is such that when placed on a table or even on the floor, the parent body parts are in an ideal position relative to the infant while the parent stands or sits on the floor respectively. Without the pillow prop parents must bend over a table or the floor to reach the baby during caretaking. With the pillow prop parents can stand erect or sit upright at a table or even on the floor while caring for their child, thus avoiding back strain and limited range of motion in responding to the infant. This is important to the parent's ability to engage in mutual exchanges with their baby.

The cavity (1), serves as well, as the storage place for the dome pillow (21). This pillow (21) of FIG. 16 has a plane surface (41) and a convex surface (43) formed by truncating a regular hemisphere parallel with its great circle so as to form a pillow that fits exactly into the cavity (1). This pillow is stable when positioned on a flat surface with its flat side (41) and it is unstable in almost all directions when the convex surface (43) is supported by a flat surface.

Figure 9:
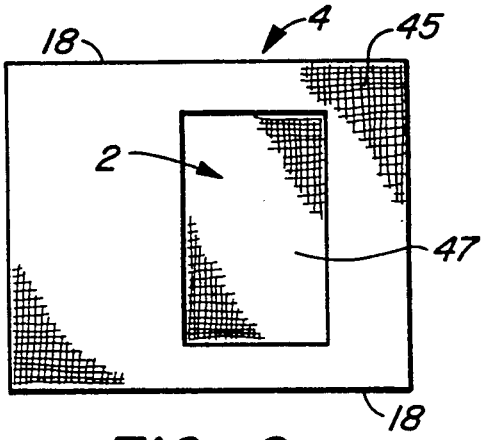
FIG. 9 is a bottom view of the simple wedge with a cavity cutout for the detail pillows.
Figure 10:
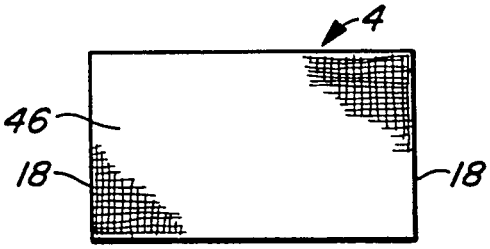
FIG. 10 is an end view of the simple wedge.
Figure 14:
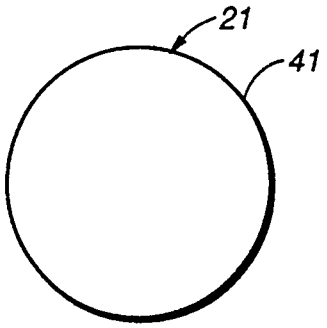
FIG. 14 is a top view of the partial half-dome pillow.
Figure 15:
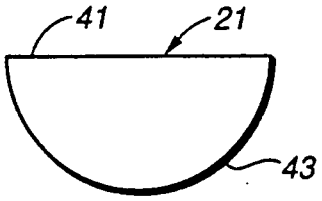
FIG. 15 is a side view of the partial half-dome pillow.

Referring now to the simple wedge (4) of FIG. 6, the form is shown inverted and a is simple right angle solid triangular wedge. It has an upper surface, (44), a lower surface (45) FIG. 9, a rear surface (46) FIG. 10, and a pair of identical side surfaces (18).

The hypotenuse plane or wedge surface, (9), of the simple wedge (4) is broken by a rectangular cavity, (2), that has a bottom (47) which is parallel with the surface (9). The cavity, (2), accepts the detail pillows (25) FIG. 22, FIG. 25, FIG. 28, so that they are flush with the plane (9). The primary functions of this cavity is to store and organize the detail pillows 25, 27 and 29 of this invention when they are not in use.

Figure 19:
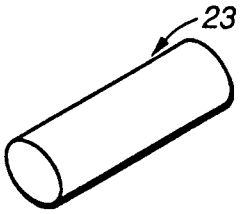
FIG. 19 is a perspective side and end view of the oblong round detail pillow.
Figure 20:
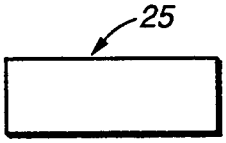
FIG. 20 is a side view of the oblong square cross-section detail pillow.
Figure 21:
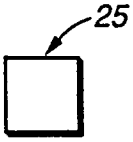
FIG. 21 is a end view of the oblong square cross-section detail pillow.

The detail pillow (23) in FIG. 19 is a round cross-section column, of a size that when a baby's limbs or torso are supported by it, they have maximum range and directional freedom. The baby's motion will be facilitated in a direction perpendicular to the axis of the column and inhibited in the other directions. This round column (23) is the most moveable in one direction of all the detail pillows in this invention. The other oblong pillows are progressively more stable in the direction that crosses their axis. When an infant relates to this pillow, the motion at their multi-directional joints is inhibited and the motion at their unidirectional joints will be facilitated.

Figure 22:
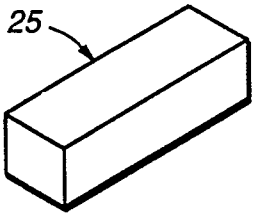
FIG. 22 is a perspective top, side, and end view of the oblong square cross-section pillow.
Figure 23:
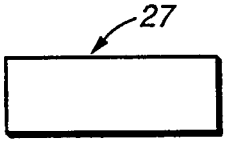
FIG. 23 is a top view of the oblong rectangular cross-section detail pillow.
Figure 24:
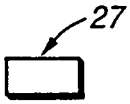
FIG. 24 is a end view of the oblong rectangular cross-section detail pillow.

The detail pillow (25) depicted in FIG. 22 is a square cross-section column, that fits the body part sizes of newborn infants. When a baby is laid prone over this pillow, efforts of the leg and arms will tend to cause the infant to move forward or backward. The square cross-section oblong pillow moves only perpendicular to its axis and in discrete increments, turning over one side at a time. This helps the infant to experience the effects of his or her own effort. It also gives the parent a means of meaningful exchanges with their infant.

Figure 28:
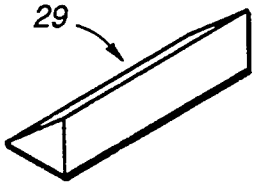
FIG. 28 is a perspective side and end view of the oblong wedge detail pillows.

The detail pillow (29) shown in FIG. 28 of which there are two identical units in this invention, is a right angled triangular cross-section solid. They are used as the other pillows in FIGS. 19 and 22 except that they are even more stable than the other two and can be used to block and support babies body parts as well as those of adults. The form and size just fits the small spaces between arms and torso and legs of newborns and when used to factor the infants environment, serve the purpose of giving babies stable masses to inhibit some movements and facilitate others.

Figure 25:
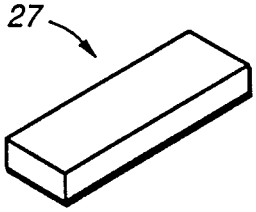
FIG. 25 is a perspective top, side and end view of the oblong rectangular cross-section detail pillow.
Figure 26:
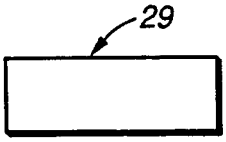
FIG. 26 is aside view of the oblong wedge detail pillows of which ther are two.
Figure 27:
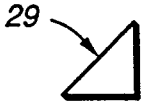
FIG. 27 is an end view of the oblong wedge detail pillows.

The detail pillow (27) in FIG. 25 is the most stable of all pillow forms, in this invention. It fits under and between the baby's body parts and serves to support them in small stable increments.

Figure 13:
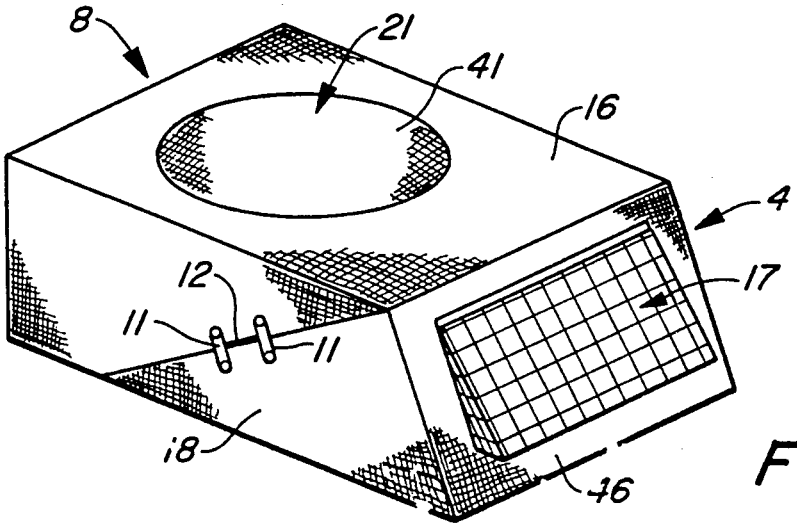
FIG. 13 is a perspective view of the foundation pillows of the present invention with the scoop wedge, on top and the simple wedge on the bottom. The partial half dome detail pillow is stored in the scoop. The detail pillow storage net is also shown as is the carrying handle attached the strap and snap feature located on each side and used to secure the whole set in one solid geometric form.

The detail pillow (23), because of its cylindrical shape, may be stored in the storage net 17 attached to the rear surface (46) (FIG. 13).

This invention is a material, practical means to help parents become skilled in relating to their newborn children by providing them with forms and equipment that will allow them to give their infant every possible spatial condition for body movement during the early development of their child's motor-sensory skills foundation on a prolonged if not continuous basis. The invention helps parents to understand the tasks that a newborn faces leaving the self-created environment of the womb and learning to cope in the environment created by grown-ups for grown-ups. It gives parents a means to participate in that learning by bridging the chasm and meeting the infant part way with an environment that takes into account the size, strength, and timing differences between adults and babies. This invention is a tool to enhance the foundations of human relation skills. It is the means by which parents and babies can learn mutual respect and gain competence in equal sided or mutual exchanges.

It will be appreciated from the foregoing that many variations can be made with respect to the details of the pillow prop furniture without departing from the spirit of the invention. For instance, the forms can be made from any suitable material, or made to any size to fit different individuals. Furthermore, it should also be realized that this invention is not to be construed as limited to the particular forms disclosed herein since these are to be regarded as illustrative rather than restrictive. We intend therefore to be bound only by the following patent claims:

We claim:

1. An apparatus to optimize the neurological development in an infant placed therein and to position the infant in relation to a care giver to enhance mutual interaction skills, comprising:

a plurality of pillows shaped in different geometrical configurations;

said pillows including first and second foundation pillows, each being substantially wedge shaped and having an inclined planar surface thereon, said first foundation pillow having a substantially hemispherical first recess therein in said inclined planar surface thereof, said second foundation pillow having a second recess therein, said pillows further including a plurality of detail pillows, each of which is substantially smaller than either one of said foundation pillows, said detail pillows including a substantially hemispherical detail pillow adapted to fit in and conform to said first recess, and including a plurality of further detail pillows adapted to collectively fit in and conform to said second recess, said detail pillows providing unidirectional and compound-directional motion such that said pillows match human joint actions to support and optimize the neurological development in infants; and connection means for interconnecting said first and second foundation pillows with said inclined planar surfaces in mating contact to form a substantially rectangular solid.

2. The apparatus of claim 1 wherein said detail pillows comprise a plurality of surface configurations to provide additional support for an infant.

3. The apparatus of claim 1 wherein said pillows are formed from medium density foam.

4. The apparatus of claim 3 wherein said foam is covered with suitable resilient material.

5. The apparatus of claim 1 including handle means for moving said apparatus.

6. The apparatus of claim 5 wherein said handle means includes straps suitably connected to said apparatus.

* * * * *

UNITED STATES PATENT AND TRADEMARK OFFICE

CERTIFICATE OF CORRECTION

PATENT NO. : 5,035,015

DATED : July 30, 1991

INVENTOR(S) : Linda S. Maietta & Frank W. Hatch

It is certified that error appears in the above-identified patent and that said Letters Patent is hereby corrected as shown below:

ON THE TITLE PAGE:

At [76] add Frank W. Hatch, ~~Rte 9, Box 86 H.M.~~, Santa Fe, N. Mex. 87505 as one of the inventors.

Column 3, line 28, "ther" should be --there--.

Column 7, line 14, "We claim" should be --WHAT IS CLAIMED IS:--

Column 3, line 27, "aside" should be --a side--.

Column 5 lines 38, "here" should be --her--.

Column 5 lines 67, "a is" should be --is a--.

Column 6 lines 51, delete "( )" around --FIG. 13--.

Signed and Sealed this

Ninth Day of February, 1993

*Attest:*

STEPHEN G. KUNIN

*Attesting Officer*

*Acting Commissioner of Patents and Trademarks*